US005143095A

United States Patent [19]

Lasch et al.

[11] Patent Number: 5,143,095

[45] Date of Patent: Sep. 1, 1992

[54] METHOD OF CUTTING TOBACCO

[75] Inventors: Manfred Lasch; Klaus-Georg Hackmack; Reinhard Liebe, all of Hamburg, Fed. Rep. of Germany

[73] Assignee: Körber AG, Hamburg, Fed. Rep. of Germany

[21] Appl. No.: 494,733

[22] Filed: Mar. 16, 1990

[30] Foreign Application Priority Data

Mar. 18, 1989 [DE] Fed. Rep. of Germany ..... 3908937

[51] Int. Cl.[5] ..... A24B 3/07

[52] U.S. Cl. ..... 131/290; 131/117; 131/118; 131/322

[58] Field of Search ..... 131/290, 249, 300, 302, 131/303, 304, 305, 311, 306, 313, 314, 322, 324, 117, 118

[56] References Cited

U.S. PATENT DOCUMENTS 3,372,703 3/1968 Conard .
3,948,277 4/1976 Wochnowski .
4,004,594 1/1977 Wochnowski .
4,054,145 10/1977 Berndt .
4,116,203 9/1978 Wochnowski .
4,582,070 4/1986 Jewell ..... 131/303
4,615,343 10/1986 Komossa .
4,799,501 1/1989 Liebe .

FOREIGN PATENT DOCUMENTS 2138666 10/1984 United Kingdom .
2187632 9/1987 United Kingdom .

*Primary Examiner*—V. Millin
*Attorney, Agent, or Firm*—Peter K. Kontler

[57] ABSTRACT

A method of converting particles of tobacco leaves, particularly bales or portions of bales of compacted tobacco leaf laminae, into cut tobacco involves admitting portions of and/or entire bales into a tobacco cutter while the temperature of compacted particles matches or exceeds the room temperature of 18°-25° C. and the moisture content of the particles is between 10 and 17 percent.

34 Claims, No Drawings

METHOD OF CUTTING TOBACCO

CROSS-REFERENCE TO RELATED CASE

A method of mainpulating bales of tobacco particles which is somewhat similar to the method of the present invention is described in copending U.S. patent application Ser. No. 07/494,676 filed Mar. 16, 1990 by Manfred Lasch et al. for "Method of and apparatus for manipulating bales of condensed tobacco particles".

BACKGROUND OF THE INVENTION

The invention relates to the treatment of tobacco in general, and more particularly to improvements in methods of making cut tobacco from loose tobacco leaf laminae and/or loose tobacco ribs or from packages of compacted or condensed tobacco leaf laminae and/or tobacco ribs.

Harvested tobacco leaves are normally subjected to a pronounced drying action so that their moisture content is reduced to approximately 8–11 percent. The thus dried tobacco is thereupon condensed into cylindrical, block-shaped or otherwise configurated packages (hereinafter called bales for short). The particles which form the bales can consist exclusively of tobacco leaf laminae (i.e., stripped tobacco leaves (also called strips) which are devoid or practically devoid of ribs), exclusively of tobacco ribs, or of a mixture of laminae and ribs. If the stripping of tobacco leaves takes place prior to baling, the ribs are or can be stored separately to be cut and admixed to cut laminae in a cigarette maker or the like. An advantage of bales of compacted or condensed laminae and/or ribs is that they can be stored for extensive periods of time and occupy little room in storage and during transport.

When the particles of the bales are to be converted into fillers of cigarette rods or other tobacco-containing rods in accordance with heretofore known procedures, the bales must be broken up, i.e., the coherent particles (be it ribs and/or laminae) must be singularized in a complex and time consuming manner. The reason is that the relatively dry and hence brittle particles strongly adhere to each other so that the separating operation must be carried out with great care in order to avoid excessive comminution of the particles prior to actual cutting. It is customary to introduce a bale into a vacuum chamber and to drive into the bale one or more hollow mandrels which serve to admit steam. The thus admitted steam tends to escape into the chamber because its pressure exceeds the pressure in the chamber. This results in heating and moisturizing of the particles, i.e., the particles become or are supposed to become supple and to be readily separable from each other. Reference may be had, for example, to U.S. Pat. No. 3,372,703. A drawback of the patented procedure is that the energy requirements of the bale breaking or loosening apparatus are very high and that such apparatus are complex, bulky and expensive. As a rule, the apparatus will raise the moisture content of particles to approximately 12–14 percent which is considered an acceptable value for enhancing the suppleness of the particles and for facilitating their separation without undue breakage. Such preliminary moisturizing to between 12 and 14 percent is followed by additional moisturizing in order to raise the moisture content to between about 18 and 23 percent. This is considered by experts to be an optimum moisture content of tobacco particles which consist of tobacco leaf laminae and are about to be shredded. The moisture content of tobacco ribs which are about to be cut is raised to as high as 30 percent. A modern tobacco cutter operates with two convergent chains which subject the moisturized particles to a pronounced compressing action to form a so-called cake which is fed through a mouthpiece and into the range of a set of orbiting knives serving to convert the leader of the cake into cut or comminuted tobacco in the form of shreds. The shreds are thereupon dried in order to reduce their moisture content to a value (e.g., between 12.5 and 13.5 percent) which is satisfactory or best suited for gathering of shreds into a stream in a cigarette rod making machine.

The above outlined steps of a conventional method of breaking up bales and of converting their particles into shreds which are ready for the making of tobacco fillers involve heating and moisturizing, additional moisturizing, pronounced compacting in the cutter and subsequent drying. This consumes much energy and contributes significantly to the cost of the ultimate products.

U.S. Pat. No. 4,799,501 to Liebe et al. discloses a modified method and apparatus wherein the vacuum chamber is replaced with a microwave oven. The oven heats the particles of bales and weakens the bonds between neighboring particles. The loosened particles are wetted in order to raise their moisture content to a value which is considered to be best suited for conversion into a cake between the convergent chains of a cutter. Cut particles of tobacco are thereupon dried down to the moisture content which is necessary for introduction into a cigarette rod making machine. Thus, though the method and apparatus of Liebe et al. dispense with moisturizing of particles which are condensed into bales, it is still necessary to moisturize the loosened particles prior to cutting and to thereupon dry the cut or comminuted particles preparatory to further processing, e.g., into the fillers of cigarette rods. Such moisturizing and drying steps involve the expenditure of considerable amounts of energy.

Published British patent application No. 2 187 632 discloses a method and an apparatus wherein bales of condensed and relatively dry tobacco particles are heated by subjecting them to the action of microwaves. The thus treated bales are fed into a cutting or comminuting machine prior to cooling of the particles back to starting temperature. The accumulations of packages which are being fed into the cutting machine must have a predetermined width and height; therefore, it is often necessary to break up the bales into fragments for the purpose of admitting the fragments into the cutting machine. The breaking up of bales into smaller portions or fragments which are ready for admission into the cutting machine is costly and takes up much time. In addition, remnants of bales which do not have the required width and height must be shredded or otherwise comminuted in separate machines.

OBJECTS OF THE INVENTION

An object of the invention is to provide a method which renders it possible to dispense, at least at times, with the step of breaking up large bales into smaller accumulations of coherent tobacco particles prior to the comminuting step.

Another object of the invention is to provide a method which renders it possible to dispense with moisturizing of tobacco particles prior to the cutting step and which can be practiced without the need for comminution of bales into portions or accumulations having a given height and width.

A further object of the invention is to provide a method which renders it possible to dispense with vacuum chambers and which can be practiced in connection with the manipulation of bales containing tobacco leaf laminae and/or tobacco ribs as well as in connection with the manipulation of all available brands of tobacco including Burley, Virginia and Oriental.

An additional object of the invention is to provide a method of cutting tobacco with substantial savings in energy.

Still another object of the invention is to provide a method of making cut tobacco having a filling power which is more satisfactory than that of cut tobacco which is obtained in accordance with conventional methods.

SUMMARY OF THE INVENTION

The invention resides in the provision of a method of comminuting tobacco, particularly for cutting tobacco leaves and/or ribs which are condensed or compacted into bales or portions of bales. The method essentially comprises two successive steps, namely a step (a) of imparting to tobacco a moisture content of 10–17 percent and a temperature which at least matches the room temperature of 18°–25° C., and a step (b) of introducing the tobacco (at a temperature of at least 18°–25° C. and moisture content of 10–17 percent) into a cutter wherein the tobacco is cut. The step (a) preferably includes imparting to tobacco a moisture content of 11–16 percent. The step (a) can further comprise compacting or condensing tobacco into bales or portions of bales, and the step (b) then comprises (or can comprise) introducing the bales or portions of bales into the cutter, preferably without moisturizing and/or heating. Alternatively, the bales or portions of bales can be heated to a temperature of at least 30° C. The step (a) of such method can further comprise loosening the bales or portions of bales immediately following heating to at least 30° C.

The step (a) can include heating tobacco to a temperature of at least 40° C., e.g., up to 50° C.

The bales or portions of bales can be heated to at least 30° C., and such heating can include subjecting the bales or portions of bales to the action of microwaves or to the action of at least one electric high frequency field.

The step (a) can include heating and simultaneously moisturizing the tobacco. The heating and moisturizing can include introducing steam into bales or portions of bales and reducing the pressure around the bales or portions of bales to below atmospheric pressure. The steam introducing step can include driving one or more hollow mandrels into the bales or portions of bales, and admitting steam by way of the hollow mandrel or mandrels.

The bales or portions of bales can be heated to a temperature of 30°–60° C. (preferably between 40° and 50° C. and most preferably approximately 40° C.) prior to admission into the shredder. The step (a) of such method preferably includes imparting to the bales or portions of bales a moisture content of 13–16 percent, preferably approximately 14 percent. The step (b) preferably includes introducing the bales or portions of bales into the cutting while the temperature and the moisture content of tobacco at least approximate the temperature and the moisture content upon completion of the step (a). The step (a) can further comprise loosening the bales or portions of bales following the heating and moisturizing. The step (b) of such method can comprise introducing loosened tobacco into a cutting without appreciable changes of temperature and moisture content of tobacco. The step (a) of this method can further comprise raising the temperature and moisture content of loosened tobacco. Such raising of the temperature and moisture content of tobacco can include contacting loosened tobacco with steam.

The method can further comprise the step of moisturizing the cut tobacco which issues from the cutter. Such moisturizing step can immediately follow the step (b), and the moisturizing step can include raising the moisture content of cut tobacco to a value which is necessary for the processing of cut tobacco into cigarettes or other smokers' products. Alternatively, the moisturizing step can include raising the moisture content well above that which is necessary for the processing of cut tobacco into smokers' products, and the method then further comprises the step of reducing the moisture content of moisturized cut tobacco, particularly to a value which is necessary for the processing of cut tobacco into smokers' products, such as cigarettes.

The moisturizing step can include contacting the cut tobacco with steam, preferably while the cut tobacco is agitated in the course of the moisturizing step. Such agitating step can include conveying the cut tobacco through a vibrating channel or tunnel. Alternatively, the moisturizing step can include conveying the shreds through a rotating drum.

The method can further comprise the step of contacting the cut tobacco with at least one flavoring agent, e.g., sauce.

The step (a) or a step following the step (b) can comprise blending different types of tobacco, particularly different types of tobacco leaf laminae and/or tobacco ribs.

The novel features which are considered as characteristic of the invention are set forth in particular in the appended claims. The improved method itself, however, will be best understood upon perusal of the following detailed description of certain presently preferred specific embodiments.

DESCRIPTION OF PREFERRED EMBODIMENTS

Basically, the improved method comprises maintaining portions of tobacco leaves (e.g., tobacco leaf laminae and/or tobacco ribs in the form of compacted bales or portions of bales) at a temperature which matches or exceeds the room temperature (18°–25° C.) and with a moisture content of 10–17 percent, and introducing such portions of tobacco leaves into the channel between the convergent chains of a cutter, e.g., a cutter of the type disclosed in commonly owned U.S. Pat. No. 4,615,343. In other words, it is not necessary to loosen the particles which form the bales or portions of bales. However, at least partial loosening of bales or portions of bales may be desirable and advantageous under certain circumstances and for certain reasons which will be described hereinafter. If a loosening is desired or necessary, it can involve raising the temperature and/or the moisture content of tobacco which is about to be introduced into the cutter. Highly satisfactory results were obtained when the particles of tobacco which was introduced into the cutter had a moisture content of 11–16 percent, especially between 13–16 percent (preferably approximately 14 percent). Cutting of tobacco particles having a moisture content of 12.5–13.5 percent is desirable and advantageous because this value is considered to be best suited to constitute the moisture content of cut tobacco which is about to be converted into the fillers of cigarettes or other smokers' products. Under certain exceptional circumstances, the range of 12.5–13.5 percent can be departed from in the upward or downward direction without unduly affecting the filling power and/or certain other important parameters of smokers' products. It has been found that tobacco particles having a moisture content in the range of 10–17 percent can be cut in a highly satisfactory way, i.e., it is not necessary to raise the moisture content to 18–23 percent prior to the cutting step. Thus, one can dispense with moisturizing of tobacco particles prior to cutting and with drying of tobacco shreds to processing values. Moreover, the particles of tobacco are subjected to less pronounced mechanical stresses because one can dispense with moisturizing of tobacco particles as well as with drying of cut tobacco. All this ensures that the final products contains a higher percentage of desirable relatively long shreds.

If the tobacco particles are delivered to the cutter in the form of bales or portions of bales, they can be heated to a temperature of at least 30° C., preferably at least 40° C. (for example, between 40° and 50° C. because this further enhances the quality of cut tobacco. The reason for heating of tobacco bales or portions of bales above room temperature is that the particles of bales or portions of bales which are admitted into the cutter at room temperature or at a temperature only slightly exceeding room temperature, and the moisture content of which matches or only slightly exceeds storage or shipment moisture content, are likely to be damaged during separation from each other, especially if the particles consist, or contain a rather high percentage, of tobacco leaf laminae. Therefore, it is desirable under the above outlined circumstances, to deliver into the cutter tobacco particles which are compacted into bales or portions of bales of the type commonly used for storage and transport of tobacco. The quality of tobacco shreds is improved if the cutter receives a series of identical or nearly identical bales or portions of of bales which at least substantially fill the channel between the convergent chains of the cutter. It is desirable to ensure that the bales or portions of bales fill the channel across the full width of the chains, i.e., transversely of the direction of advancement of tobacco cake toward the mouthpiece of the cutter. Thus, admission of bales or portions of bales having predetermined dimensions enhances the quality of the cutting action and also prolongs the useful life of the cutter.

Of course, the exact dimensions of the bales or portions of bales are of little or no importance if the cutting step is preceded by a loosening step. The particles of loosened bales or portions of bales can be delivered to the cutter at an optimum rate irrespective of the dimensions of bales or portions of bales prior to the loosening step. A mere heating of bales or portions of bales can suffice to ensure a desirable loosening prior to admission of tobacco into the cutter. Such admission preferably takes place prior to any or any appreciable cooling of loosened bales or portions of bales.

It has been found that adequate loosening of bales or portions of bales can be achieved without appreciable heating and/or moisturizing. For example, if the moisture content of tobacco particles in the bales or portions of bales is or approximates 11 percent (i.e., the shipment or storage moisture content), it suffices to raise the temperature only slightly above room temperature, e.g., to 30° C. The loosening action improves if the temperature of the bales or portions of bales is raised above 30° C. Loosening of bales or portions of bales can be complete or partial, i.e., it often suffices to loosen some of the leaf laminae and/or ribs and to permit the remaining tobacco particles to form smaller or larger clumps as long as the loosened tobacco portions and the clumps jointly fill the channel between the convergent chains of the cutter. The admission of loosened or partially loosened tobacco particles into the cutter is preferably swift so that the loosened and/or partially loosened particles are not permitted to cool down to the temperature prior to heating preparatory to loosening or partial loosening. In other words, cooling of tobacco particles during transport from the loosening station into the cutter should be negligible or nil; this reduces the likelihood of excessive mechanical stressing and breakage of loosened or partly loosened tobacco particles by the chains and/or other parts of the cutter. As a rule, heating of tobacco bales or portions of bales will be such that the temperature of particles in the cutter is at least 30° C., preferably at least 40° C. and most preferably between 40° and 50° C. This ensures that the particles are sufficiently supple to withstand the mechanical stresses which arise in the course of the cutting operation. Heating with microwaves can be carried out in a manner as disclosed in the aforementioned U.S. Pat. No. 4,799,501. This mode of heating does not or need not involve simultaneous rise of moisture content of tobacco particles.

Suppleness of tobacco particles which enter the cutter can be enhanced still further by raising their moisture content simultaneously with or in lieu of the heating step. Thus, the temperature of tobacco particles need not be increased at all if the particles are moisturized prior to admission into the cutter. As already mentioned above, moisturizing can be carried out by driving one or more hollow mandrels into bales or portions of bales of compacted tobacco particles preparatory to introduction of steam by way of the mandrel or mandrels while the pressure around the bales or portions of bales is reduced below atmospheric pressure. Reference may be had to the aforementioned U.S. Pat. No. 3,372,703. Steam which is discharged by the hollow mandrel or mandrels not only heats but also moisturizes the particles of tobacco to thereby prepare the bales or portions of bales for admission into the cutter in the absence of any or in partly or fully loosened condition.

It has been found that a highly satisfactory compromise between the outlay for equipment and the quality of cut tobacco particles is achieved if the bales or portions of bales are heated to a temperature of 30°–60° C., preferably between 40° and 50° C., while the moisture content of the particles is maintained at, raised to or lowered to 13–15 percent, preferably to about 14 percent. If one adheres to these parameters, the outlay for energy and equipment which is required to heat and (if necessary) dry the tobacco particles is much less than if the moisture content of tobacco particles raised to at least 18 percent prior to the cutting step and/or if the temperature of tobacco particles were raised to a relatively high value prior to cutting. The plants which can be used for the practice of the improved method are relatively simple and inexpensive and the quality of cut tobacco (particularly its taste) is influenced only little or not at all because the temperature of tobacco particles need not be raised well above the room temperature. This also enhances the filling power of cut tobacco, particularly since the particles need not be heated to an elevated temperature and maintained at such elevated temperature for an extended interval of time for the purpose of reducing the moisture content of cut tobacco to the processing value.

It has been discovered that, if tobacco particles are to be heated and/or moisturized prior to cutting, the shredding operation is particularly satisfactory if the condition (moisture content and temperature) of the particles is not changed during the interval from heating and moisturizing to the cutting step. This holds true irrespective of whether the treatment which precedes the cutting step involves a partial or complete loosening of bales or portions of bales. Steaming of loosened or partially loosened bales or portions of bales can be resorted to in order to prevent excessive cooling and/or drying of tobacco particles prior to admission into the cutter. In addition, treatment with steam can initiate or promote the loosening of bales or portions of bales. Such treatment with steam can involve contacting the bales or portions of bales With saturated steam or dry steam which contacts the bales or portions of bales and/or the particles of partially or completely loosened bales or portions of bales. This treatment with steam can take place while the particles of tobacco are transported by a vibratory conveyor. Steam can be admitted from below. The steaming step can involve raising the temperature of tobacco particles to approximately 60° C. However, the temperature of tobacco particles can be raised to as high as 90° C.

EXAMPLE I

Compacted green Burley tobacco leaf laminae with a moisture content of 8.5, 11 (shipping moisture content) and 14 percent were admitted into a cutter of the type known as KTH (distributed by the assignee of the present application). The temperature of the bales or portions of bales was maintained at approximately 20° C., 40° C. and 75° C. Heating of tobacco to 40° C. and 75° C. (moisture content of 11 and 17 percent, respectively) was carried out by subjecting the bales or portions of bales to the action of microwaves. Cutter of tobacco was followed by moisturizing of the thus obtained cut tobacco to a moisture content of 15.64 percent. The filling power of moisturized cut tobacco (in mm final height of a column of cut tobacco in a standard vessel beneath a standard weight) was ascertained with a standard Borgwald densimeter of the type widely used in the tobacco processing industry.

The following table contains data denoting the relationship between the moisture content (in percent), the temperature (in °C.) and final height (in mm) of a column of cut tobacco as measured with a Borgwald densimeter:

| Moisture content | Temperature | Final height |
|---|---|---|
| 8.5 | | |
| 8.5 | 40 | 34.27 |
| 8.5 | 75 | 38.63 |
| 11 | 20 | 36.20 |
| 11 | 40 | 40.44 |
| 11 | 75 | 39.23 |
| 14 | 20 | 39.65 |
| 14 | 40 | 42.75 |
| 14 | 75 | 39.57 |

EXAMPLE II

Compacted or condensed green Virginia tobacco leaf laminae with a moisture content of 8.5, 11 (shipping moisture content) and 13 were admitted into a KTH cutter at a shredding temperature of 20° C., 40° C. and 75° C., respectively. Heating to 40° C. and 75° C. took place by subjecting the tobacco to the action of microwaves. Cutting was followed by moisturizing or demoisturizing of cut tobacco to a moisture content of 12.04 percent, and the filling power of such cut tobacco was ascertained in the same way as described in the Example I. The following table furnishes the relationships between the moisture content (in percent), the temperature (in °C.) and the final height (in mm) of a column of cut tobacco as measured with a Borgwald densimeter:

| Moisture content | Temperature | Final height |
|---|---|---|
| 8 | | |
| 8 | 40 | 36.04 |
| 8 | 75 | 37.10 |
| 11 | 20 | 34.26 |
| 11 | 40 | 38.23 |
| 11 | 75 | 38.26 |
| 13 | 20 | 38.05 |
| 13 | 40 | 38.66 |
| 13 | 75 | 38.16 |

EXAMPLE III

Compacted green Virginia tobacco leaf laminae with a moisture content of 8.4 percent (shipping moisture content) were heated above room temperature and were simultaneously moisturized by steam which was admitted by way of a hollow mandrel. The mandrel was driven into bales or portions of bales which were confined in a vacuum chamber, i.e., the pressure around the bales or portions of bales was below atmospheric pressure. The temperature of tobacco leaf laminae was raised to approximately 65° C., and their moisture content was raised to 11.6 percent. The thus conditioned bales or portions of bales were comminuted in a KTH cutter, and the moisture content of the cut tobacco was raised to 13 percent, i.e., to a value substantially corresponding to the optimum moisture content for further processing of cut tobacco into smokers' products. The final height of a column of cut tobacco at such moisture content (as measured with a Borgwald densimeter) was 36.31 mm.

The hardness of cut tobacco was similar when the cut tobacco was treated as described in the Example III above except that the bales or portions of bales were loosened prior to cutting of their leaf laminae. Thus, a sample quantity of tobacco leaf laminae with a moisture content of 11.8 percent and a temperature of approximately 65° C. was loosened, i.e., the leaf laminae of the bales or portions of bales were separated from each other. The loosening step was followed by a moisturizing step in a so-called steam channel or tunnel of the type disclosed, for example, in U.S. Pat. No. 4,004,594 in order to raise the moisture content to approximately 21 percent. The cutting operation was carried out at room temperature. The thus obtained cut tobacco was thereupon heated to a temperature of approximately 90° C. and was simultaneously agitated in a so-called HT vibratory channel or tunnel which is distributed by the assignee of the present application. Apparatus of such character are described and shown in published British patent application No. 2 138 666. The just described treatment of cut tobacco resulted in a slight rise of its moisture content. The cut tobacco was thereupon dried in a commercially available concurrent type dryer to lower their moisture content to approximately 13 percent (i.e., to a value substantially corresponding to the preferred moisture content of cut tobacco which are about to be converted into smokers' products). The final height of a column of such cut tobacco was 34.97 mm (as measured with a Borgward densimeter).

The treatment of the aforedescribed sample quantity of tobacco leaf laminae (which has been found to be the most satisfactory as presently advised) involved the utilization of three additional pieces of equipment (e.g., as compared with the equipment which was used to carry out the steps described in the Example I), namely a moisturizing unit which was used to raise the moisture content of loosened tobacco leaf laminae from 11.8 percent to 21 percent, an HT tunnel or channel which was used to heat and to simultaneously expand the tobacco leaf laminae, and a concurrent type drying drum wherein the moisture content was reduced to the processing value of approximately 13 percent. Such additional pieces of equipment contribute to the overall cost of the plant and consume substantial additional amounts of energy. Moreover, the tobacco is subjected to mechanical stresses as a result of repeated agitating, conveying and other treatments.

Other types of equipment for treating warm and dry cut tobacco (such as cut tobacco leaf laminae, cut tobacco ribs or a mixture of cut laminae and ribs), preferably immediately after the cutter the shredder (i.e., prior to cooling) are described and shown in U.S. Pat. Nos. 4,054,145 and 3,948,277. These patents describe moisturizing drums for cut tobacco. Apparatus of the type described in the aforementioned published British patent application No. 2 138 666 (namely so-called steam tunnels channels wherein the cut tobacco is conveyed by a vibratory conveyor which is provided with inlets for steam) are also disclosed in the aforementioned U.S. Pat. No. 4,004,594. The moisturizing step normally involves raising or reducing the moisture content to the processing value of 12–13.6 percent subsequent to cooling to room temperature, i.e., to a moisture content which is considered desirable for processing into cigarettes or other smokers' products. This reduces or minimizes the energy requirements of the apparatus.

The moisture content of cut tobacco can be raised to and above 20 percent in order to increase the filling power, and such moisturizing is followed by drying to between about 12–13.6 percent moisture content. If desired or necessary, the moisturizing step preferably takes place immediately after cutting, i.e., this treatment involves raising the moisture content of relatively dry cut tobacco which is still warm.

Additional treatment of cut tobacco can involve contacting with one or more flavoring agents, such as sauce. Moreover, if the cut tobacco consists of or contains Burley tobacco, it can be heated to a temperature which suffices to ensure expulsion of ammonia. Reference may be had to numerous United States patents of the assignee of the present application wherein the requisite temperature ranges and suitable heating apparatus are described in full detail.

An important advantage of the improved method is that tobacco leaf laminae and/or tobacco ribs, particularly bales or portions of bales of compacted or condensed tobacco particles, can be processed to yield high-quality cut tobacco with minimal expenditures for energy and by employing a relatively simple, compact and inexpensive processing plant. Thus, the plant which is employed for the practice of the improved method can often dispense with complex, bulky and expensive tobacco loosening, moisturizing and drying equipment which is always necessary for the practice of conventional methods. The possibility of dispensing with such loosening, moisturizing and drying equipment brings about several additional advantages, namely a pronounced reduction of mechanical stressing (i.e., the percentage of desirable longer shreds is higher) and the absence or reduction of undesirable changes of flavor and/or other characteristics of tobacco.

Loosening of bales or portions of bales prior to introduction into the channel between the convergent chains of a tobacco cutter is desirable in order to ensure more satisfactory operation of, and to reduce the wear upon, the cutter. Such loosening can be promoted by slightly raising the moisture content and/or the temperature of tobacco. Relatively simple, reliable and inexpensive equipment for such loosening is available on the market, and the energy requirements of such equipment are low. The reason is that the loosening need not be complete, i.e., it suffices to achieve a partial or coarse loosening as long as the selected mode of loosening suffices to enable the cutter to form a substantially homogeneous tobacco cake which is converted into cut tobacco.

Two or more blends of cut tobacco leaf laminae and/or ribs can be mixed prior to conversion into smokers' products. A suitable mixing apparatus is disclosed in U.S. Pat. No. 4,116,203.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of comminuting tobacco leaves and/or ribs which are condensed into bales or portions of bales, comprising successive steps of (a) imparting to tobacco a moisture content of 10–17 percent and a temperature of at least 18°–25° C.; and (b) introducing the tobacco into a cutter.

2. The method of claim 1, wherein said step (a) includes imparting to tobacco a moisture content of 11–16 percent.

3. The method of claim 2, wherein said step (a) includes compacting tobacco into bales or portions of bales, and said step (b) includes introducing the bales or portions of bales into the cutter without moisturizing and/or heating.

4. The method of claim 1, wherein said step (a) includes compacting tobacco into bales or portions of bales and heating the bales or portions of bales to a temperature of at least 30° C.

5. The method of claim 4, wherein said step (a) further comprises loosening the bales or portions of bales immediately following heating to at least 30° C.

6. The method of claim 1, wherein said step (a) includes heating tobacco to a temperature of at least 40° C.

7. The method of claim 1, wherein said step (a) comprises compacting tobacco into bales or portions of bales and heating the bales or portions of bales to at least 30° C. including subjecting the bales or portions of bales to the action of microwaves.

8. The method of claim 1, wherein said step (a) comprises compacting tobacco into bales or portions of bales and heating the bales or portions of bales to at least 30° C. including subjecting the bales or portions of bales to the action of at least one electric high frequency field.

9. The method of claim 1, wherein said step (a) comprises heating and simultaneously moisturizing the tobacco.

10. The method of claim 9, wherein said step (a) comprises compacting tobacco into bales or portions of bales, said heating and moisturizing including introducing steam into the bales and portions of bales and reducing the pressure around the bales and portions of bales below atmospheric pressure.

11. The method of claim 10, wherein said steam introducing step includes driving a hollow mandrel into the bales or portions of bales and admitting steam by way of the hollow mandrel.

12. The method of claim 1, wherein said step (a) comprises compacting tobacco into bales or portions of bales and heating the bales or portions of bales to a temperature of 30°-60° C.

13. The method of claim 12, wherein said temperature is between 40° and 50° C.

14. The method of claim 12, wherein said temperature is approximately 40° C.

15. The method of claim 12, wherein said step (a) comprises imparting to the bales or portions of bales a moisture content of 13-16 percent.

16. The method of claim 15, wherein the moisture content of bales or portions of bales is approximately 14 percent.

17. The method of claim 15, wherein said step (b) comprises introducing the bales or portions of bales into a cutter while the temperature and the moisture content of tobacco at least approximate the temperature and the moisture content upon completion of said step (a).

18. The method of claim 17, wherein said step (a) further comprises loosening the bales or portions of bales following said heating and moisturizing.

19. The method of claim 18, wherein said step (b) comprises introducing loosened tobacco into a cutter without appreciable changes of temperature and moisture content of tobacco.

20. The method of claim 18, wherein said step (a) further comprises raising the temperature and moisture content of loosened tobacco.

21. The method of claim 20, wherein said raising the temperature and moisture content of loosened tobacco includes contacting loosened tobacco with steam.

22. The method of claim 1, further comprising the step of moisturizing cut tobacco which issues from the cutter.

23. The method of claim 22, wherein said moisturizing step immediately follows said step (b).

24. The method of claim 22, wherein said moisturizing step includes raising the moisture content of shreds to a value which is necessary for the processing of cut tobacco into smokers' products.

25. The method of claim 22, wherein said moisturizing step includes raising the moisture content of cut tobacco to a value above that which is necessary for the processing of cut tobacco into smokers' products, and further comprising the step of reducing the moisture content of moisturized cut tobacco.

26. The method of claim 22, wherein said moisturizing step includes contacting the cut tobacco with steam.

27. The method of claim 26, further comprising the step of agitating the cut tobacco in the course of said moisturizing step.

28. The method of claim 27, wherein said agitating step includes conveying the cut tobacco through a vibrating channel.

29. The method of claim 22, wherein said moisturizing step includes conveying the cut tobacco through a rotating drum.

30. The method of 1, further comprising the step of contacting the cut tobacco with at least one flavoring agent.

31. The method of claim 30, wherein said at least one flavoring agent is sauce.

32. The method of claim 1, further comprising the step of blending different types of cut tobacco.

33. The method of claim 32, wherein said blending step comprises mixing cut tobacco leaf laminae with cut tobacco ribs.

34. The method of claim 32, wherein said blending step comprises blending different types of cut tobacco leaf laminae with cut tobacco ribs.

* * * * *